US005221190A

United States Patent [19]

Romer et al.

[11] Patent Number: 5,221,190

[45] Date of Patent: Jun. 22, 1993

[54] ION SPUTTERING PUMP WITH GETTER MODULE

[75] Inventors: Joseph Romer, Bonn; Hans-Jurgen Mundinger, Bruhl; Gunther Krischer, Wesseling, all of Fed. Rep. of Germany

[73] Assignee: Leybold Aktiengesellschaft, Hanau, Fed. Rep. of Germany

[21] Appl. No.: 849,620

[22] Filed: Mar. 10, 1992

[30] Foreign Application Priority Data

Apr. 2, 1991 [DE] Fed. Rep. of Germany ..... 4110588

[51] Int. Cl.[5] ..... H01J 41/12

[52] U.S. Cl. ..... 417/51

[58] Field of Search ..... 417/48, 51; 313/553

[56] References Cited

FOREIGN PATENT DOCUMENTS 3434787 4/1986 Fed. Rep. of Germany .

121210 10/1978 Japan ..... 417/51

*Primary Examiner*—Leonard E. Smith

*Attorney, Agent, or Firm*—Felfe & Lynch

[57] ABSTRACT

The invention relates to an ion sputtering pump having a housing with at least one getter module located in the housing. The getter module has a heating device. In order to reduce the amount of time required for the activation and regeneration of the getter module, the heating device is in direct, intimate thermal contact with the getter module.

1 Claim, 1 Drawing Sheet

FIG. 1
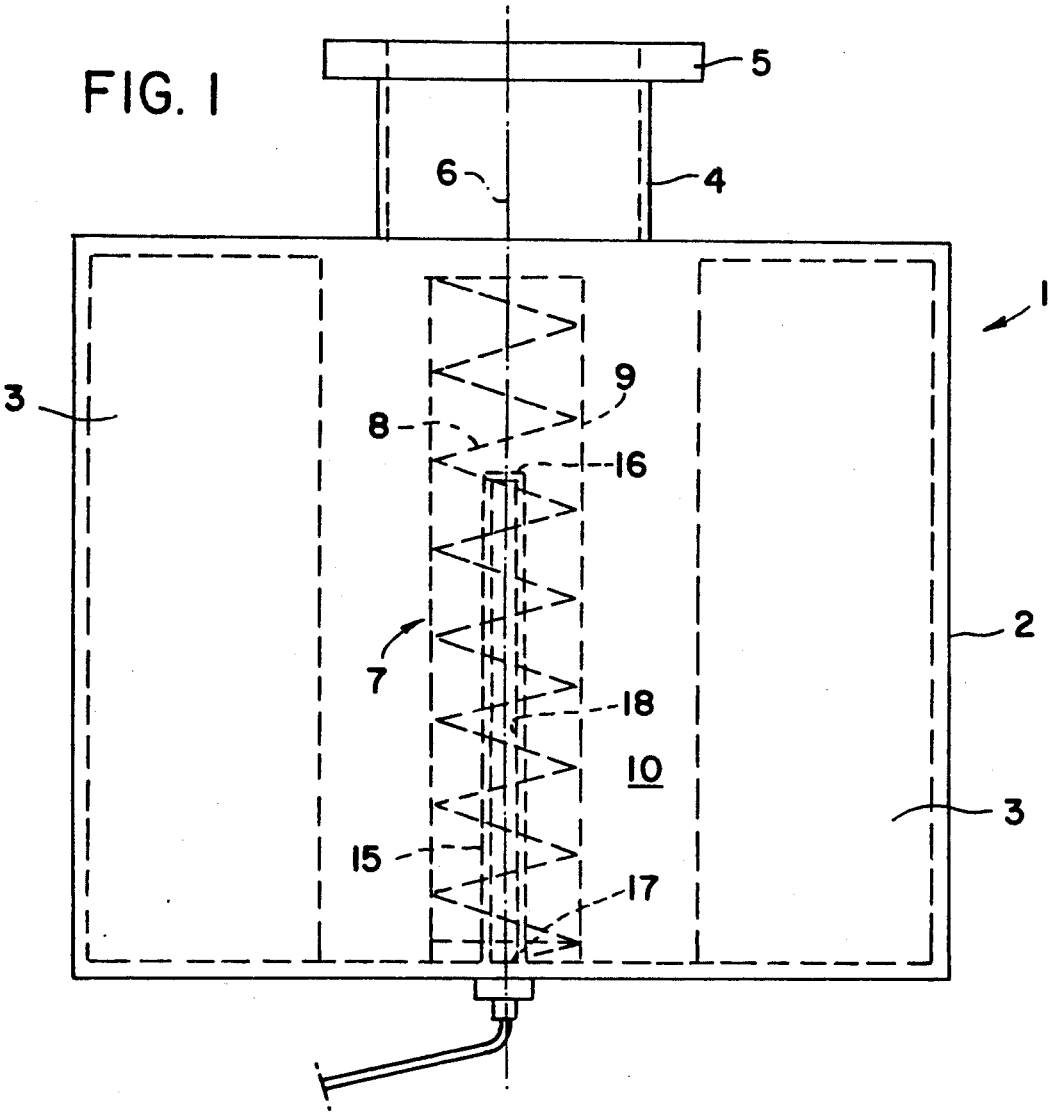
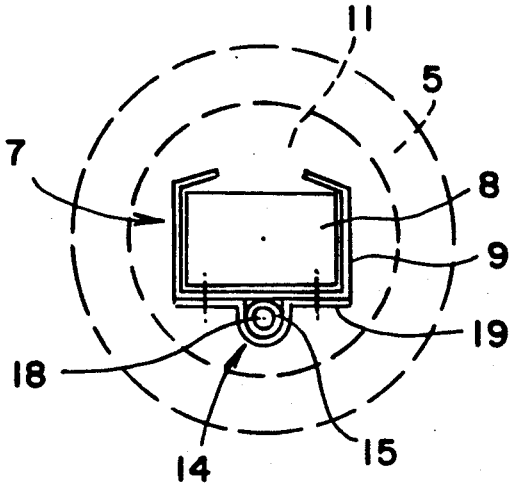
FIG. 2

ION SPUTTERING PUMP WITH GETTER MODULE

FIELD OF INVENTION

The invention relates to an ion pump using a getter for ion sorption.

BACKGROUND

The invention relates to an ion sputtering pump having a housing, with at least one getter module situated in the housing, and a heating device for the activation and regeneration of the getter module.

The pumping action of ion sputtering pumps is based on sorption processes which are triggered by ionized gas particles in a gas discharge. To sustain the gas discharge, in the ion sputtering pumps of conventional design, electrode systems configured as diodes or triodes are provided with cell anodes. The electrode system or systems are situated in a magnetic field for the purpose of prolonging the electron paths.

For the selective improvement of the pumping action of ion sputtering pumps, especially for the improvement of the hydrogen sorbing capacity, it is known to dispose a getter module within the pump housing. Known getter modules consist of folded metal strips with a supporting plate. The folded metal strip is the support of a getter material which is not vaporizable and which, after an activation by heating, binds hydrogen, nitrogen, oxygen and carbon monoxide by sorption.

In order to activate the getter module or regenerate it after saturation, a heating process is required. This is performed in known ion sputtering pumps by placing flat heating elements against the exterior of the pump housing so that the entire pump is heated. This results in relatively long activating and regenerating periods due to the large thermal mass that has to be heated.

SUMMARY OF THE INVENTION

Therefore, the present invention is addressed to the problem of configuring the heating system for the getter module in an ion sputtering pump such that the activating and regenerating time periods can be considerably shortened.

This problem is solved in accordance with the invention by associating the heating device directly with the getter module. Preferably the heating device is configured as a heating cartridge which has direct thermal contact with a supporting plate of the getter module.

The invention consists of an ion sputtering pump comprising a housing with at least one getter module located within the housing. The getter module has a heating device for the activation and regeneration of the getter module. The heating device is in intimate thermal contact with the getter module.

The heating device comprises a tubing section extending into the interior of the housing and is accessible from the exterior of the housing. The tubing section can be adapted to receive a heating cartridge to be installed within the tubing section.

The getter module also comprises a supporting plate which is intimately fastened to the tubing section to promote efficient heat conduction.

The pump also has a connecting nipple having a prolongation axis, and the getter module is located adjacent to the prolongation of the axis of said connecting nipple in the interior of the housing.

A heating device with these characteristics makes it possible to heat the getter module of the ion sputtering pump without needing to heat the entire ion sputtering pump, thereby reducing the thermal mass to be heated. In this manner not only can the activating and regenerating periods be decidedly shortened, but also higher activating temperatures can be reached (450° C. instead of the former 350° C.).

Another advantage is that during operation of the sputtering pump of the present invention the getter module is deliberately held at an elevated temperature (230° C., for example). At a temperature of this magnitude the hydrogen sorbing capacity of the nonevaporating getter material is especially high.

BRIEF DESCRIPTION OF THE DRAWINGS

These together with other objects and advantages which will be subsequently apparent, reside in the details of construction and operation as more fully hereinafter described and claimed, reference being had to the accompanying drawings forming a part hereof, wherein like numerals refer to like parts throughout.

FIG. 1 shows the construction of an ion sputtering pump with getter module;

FIG. 2 is a top view of the getter module.

DETAILED DESCRIPTION OF THE PREFERRED EMBODIMENT

The ion sputtering pump 1 represented in FIG. 1 comprises the housing 2, electrode systems 3 disposed therein, and the connections 4 with the connecting flange 5. A receptacle to be evacuated in connected to the connecting flange 5. Magnets associated externally with the ion sputtering pump 1 are not represented.

In the interior 10 of the housing 2 of the ion sputtering pump 1 is the getter module 7 which consists of the folded metal strip 8 bearing getter material, and the outer supporting plate 9 (cf. also FIG. 2). The supporting plate 9 comprises the metal strip 8 of three sides, so that the getter material is substantially freely accessible to the gases on the fourth side through the opening 11 extending over the entire height of the getter module 7.

The getter module 7 is situated adjacent the inwardly prolonged axis 6 of the connection 4, so that it is accessible through the connection 4.

According to the invention, a heating device 14 is associated directly with the getter module 7. It consists of a pipe section 15 which extends into the interior 10 of the housing 2 of the ion sputtering pump 1. The end 16 of the tube section 15 which is in the interior of the tube section 15 is closed off. The other end 17 of tube section 15 is welded to the housing 2 of the ion sputtering pump 1 such that the interior of the tube section 15 is accessible from the exterior. Within the tube section 15 is a heating cartridge 18. By means of a plurality of clips 19 the supporting plate 9 is fastened to the tube section 15 in a good heatconducting manner to promote efficient heat transfer.

For the activation or regeneration of the getter module 7, the heating cartridge 18 is placed in operation. On account of the direct contact of tube section 15 with the supporting plate 9 the getter module 7 can be heated very quickly and controlledly, without heating the other parts of the ion sputtering pump 1. The invention makes it possible in a simple manner also to operate the ion sputtering pump 1 with a getter module 7 at an elevated temperature.

Although the present invention has been shown and described with respect to preferred embodiments, various changes and other modifications which are obvious to persons skilled in the art to which the invention pertains are deemed to lie within the spirit and scope of the invention.

It is claimed:

1. An ion sputtering pump comprising:

a housing, at least one getter module within said housing, said getter module having a heating device for the activation and regeneration of said getter module, wherein said heating device is in intimate thermal contact with said getter module, said heating device comprising a tubing section extending into the interior of said housing accessible from the exterior of said housing, the getter module comprising a supporting plate which is intimately fastened to said tubing section to promote efficient heat conduction.

* * * * *